United States Patent [19]

Gross et al.

[11] 4,414,042

[45] Nov. 8, 1983

[54] METHOD OF MAKING HIGH STRENGTH STEEL TUBE

[75] Inventors: Heinz Gross, Dortmund; Friedrich Reith, Hamm; Friedhelm Retzlaff, Kamen-Methler; Karl H. Schlusnus, Hamm, all of Fed. Rep. of Germany

[73] Assignee: Hoesch Werke Aktiengesellschaft, Dortmund, Fed. Rep. of Germany

[21] Appl. No.: 106,548

[22] Filed: Dec. 26, 1979

[30] Foreign Application Priority Data

Jan. 2, 1979 [DE] Fed. Rep. of Germany ..... 2900022

[51] Int. Cl.[3] ..... C21D 8/10

[52] U.S. Cl. ..... 148/12 R; 148/12 F; 148/12.3

[58] Field of Search ..... 148/2, 12 R, 12 F, 12.1, 148/12.3, 131, 142, 144, 36, 1.27, 12 C, 12.4, 134; 75/123 N, 123 J

[56] References Cited

U.S. PATENT DOCUMENTS

| | | | |
|---|---|---|---|
| 2,222,263 | 11/1940 | Nelson | 148/12.4 |
| 3,328,988 | 7/1967 | Schmidt | 148/12 R |
| 3,673,007 | 6/1972 | Miyano et al. | 148/12.3 X |
| 3,725,049 | 4/1973 | Satoh et al. | 75/123 J |
| 3,849,209 | 11/1974 | Ishizaki et al. | 148/12 F |
| 3,945,858 | 3/1976 | Matsubara et al. | 148/2 |
| 4,008,103 | 2/1977 | Miyoshi et al. | 148/12 F |
| 4,102,711 | 7/1978 | Kunitake et al. | 148/12.3 |
| 4,137,104 | 1/1979 | Nashiwa et al. | 148/36 |
| 4,138,278 | 2/1979 | Nakasugi et al. | 148/12 R |
| 4,145,235 | 3/1979 | Gondo et al. | 148/12 C |
| 4,204,892 | 5/1980 | Economopolous | 148/12.4 X |
| 4,210,467 | 7/1980 | Klatzer et al. | 148/12 R |

FOREIGN PATENT DOCUMENTS

| | | | |
|---|---|---|---|
| 52-20322 | 2/1977 | Japan | 75/123 J |
| 428022 | 3/1975 | U.S.S.R. | 148/143 |
| 456840 | 7/1975 | U.S.S.R. | 148/131 |
| 648624 | 2/1979 | U.S.S.R. | 148/12.4 |

*Primary Examiner*—Peter K. Skiff
*Attorney, Agent, or Firm*—Max Fogiel

[57] ABSTRACT

Improved steel profiles having superior material characteristics are obtained by rolling a precipitation-hardenable fine-grain steel, cooling it from a final rolling temperature above the $A_1$-temperature down to a temperature of about 400° C. in an atmosphere in which it is allowed to overage, whereupon the steel plate or strip is then cooled down to room temperature and cold-processed to form an open profile [which can thereupon be converted into a tube by welding together its longitudinally extending edges and] which is then subjected to solution-annealing in order to dissolve coarse precipitants and subsequently further cooled to form finely dispersed precipitants in the profile.

1 Claim, No Drawings

METHOD OF MAKING HIGH STRENGTH STEEL TUBE

BACKGROUND OF THE INVENTION

This invention relates to improved steel profiles and to a method of making such profiles.

In many applications it is desirable or even necessary to use steel profiles having high strength characteristics. This is particularly true where high strength at low weight is required, for example in the case of motor vehicle components, hydraulic cylinders, steel building skeleton parts or where the dimensions of the profile are required for one reason or another, to be small so that the profile is inherently subjected to high stresses, as happens for example in oil country tubular goods used in the drilling of oil wells.

It is known in the prior art to use for the hot production of e.g. seamless tubes natural hard steels with higher carbon contents up to about 0.50% and/or other strength-improving alloying additives. When strips or sheets are formed into profiles, possibly into tubular shape, the use of this type of steel produces problems during cold-processing, slitting, edging and shaping to produce the profile, due to the deformation stress of the steels to the shaping operations. During the machine-welding operations, e.g. to weld together the adjacent edges of a strip to form it into a tube, other difficulties are encountered, particularly because these steels cannot be readily welded by electric resistance welding techniques. In some, therefore, it may be said that the problems encountered with the use of these steels have heretofor been insoluble.

It is true that the adequate electric resistance weldability of such steels may be avoided by using steel which has been liquid quenched and tempered after hot rolling (see STE 70, Merkblatt 365, "Feinkornbaustaehle fuer geschweiste Konstruktionen", Teil C, Beratungsstelle fuer Stahlverwendung, Duesseldorf, first edition, 1972) or by using fine-grain steels having higher yield strength as compared to the normally-annealed fine grain structural steels (Merkblatt 365, Teil B). However, these steels will have the requisite strength which is required at delivery status but due to their high deformation stress they will still not be suitable for cold processing themselves into profiles.

In consequence, where the industry has to produce profiles such as e.g. welded tubes, the aforementioned problems have led to a limitation of the yield strength of the profiles to approximately 500 N/mm$^2$ and of the tensile strength to approximately 650 N/mm$^2$. The tubes must be produced from strip or plates of a lower hardness steel grade having a yield strength limit of up to 500 N/mm$^2$, thereupon welded and, if a higher yield strength is required, be subjected to liquid hardening and tempering. Such liquid hardening and tempering, on the other hand, is a rather expensive procedure and, in addition, has the disadvantage that the previously produced higher strength characteristic is lost again if subsequently an austenitic heat treatment, for example normalizing or hot shaping or the like, must be carried out.

SUMMARY OF THE INVENTION

It is an object of the present invention to avoid the disadvantages of the prior art.

A more particular object is to provide an improved method of producing high strength steel profiles which avoids the aforementioned drawbacks.

An additional object of the present invention is to provide such an improved method which is relatively simple and inexpensive, i.e. which is economical.

A concomitant object of the invention is to provide an improved method of the type in question which avoids the need for tempering and hardening.

Still an additional object of the present invention is to provide an improved profile produced in accordance with the method.

Pursuant to these objects, and still others which will become apparent as the description proceeds, one aspect of the invention resides in a method of converting pre-rolled plates or strips of precipitation-hardenable fine-grain steel into steel profiles having an yield strength of ≧500 N/mm$^2$, a tensile strength of ≧600 N/mm$^2$ and high toughness. Briefly stated, this method may comprise the steps of cooling the rolled steel plates or strips from final rolling temperature above the $A_1$-temperature level down to a temperature of about 400° C. by overaging; cooling the steel plates or strips further to room temperature, cold-shaping the cooled sheet steel to form an open profile therefrom; subjecting the profile to annealing so as to dissolve coarse precipitants thereon; and cooling the profile again to form finely dispersed precipitants therein.

The term precipitation-hardenable fine-grain steel as used herein is preferably a steel having a composition of:

| | | | |
|---|---|---|---|
| 0,13 | to | 0,35% | carbon |
| 0,10 | to | 0,80% | silicone |
| 0,90 | to | 1,70% | manganese |
| max. | | 0,035% | phosphorous |
| max. | | 0,035% | sulfur |
| max. | | 0,70% | copper |
| max. | | 0,80% | nickel |
| max. | | 0,020% | nitrogen |
| max. | | 0,08% | aluminum |
| 0,02 | to | 0,20% | niobium and/or titanium and/or vanadium |

the rest being iron and conventional contaminants. This steel in finished condition has an ASTM grain size finer than 6. According to the invention it is advantageous to carry out the overaging at high temperature of the precipitation-hardenable fine-grain steel (during which no grain refining takes place). during cooling of the steel (which is preferably coiled up) above the $A_1$ temperature, preferably at a temperature of 850°–750° C.

These relatively high temperatures with subsequent cooling solely as a result of the natural heat radiation of the steel coil produces a reduced cooling speed which avoids finely dispersed precipitants and causes coagulated precipitants. An appropriate micro structure is obtained according to the invention by resorting to the above measures when the steel is strip steel that can be wound up to a coil. If the steel is in the form of plates, the same effects are obtained by subjecting the plates which are at the heat of the last rolling step, to oven cooling, which prevents or reduces radiation and convection losses. In both instances it is essential that the reduced cooling is carried out down to a temperature of about 400° C., whereas the subsequent cooling to room temperature can be carried out in any desired manner.

The reduced-speed cooling mentioned above imparts to the steel strip or steel plates a low deformation stress, which means that the steel can be readily cold-processed to an initially open profile, it can be slitted, edge-planed, shaped, calibrated and straightened. A profile which has been produced by cold processing in this manner can then preferably be converted to a closed tubular profile prior to further treatments.

The profiles produced according to the present invention, be they opened or closed in cross-section, are subsequently subjected to solution annealing above the $A_{C3}$-temperature with subsequent cooling, in order to carry out precipitation hardening (also known as particle hardening and fine grain hardening) so as to dissolve the coarse precipitants. The subsequent cooling is to bring about the formation of finely-dispersed carbides, nitrides and carbonitrides at simultaneous formation of fine grain. If the invention is used to produce stretch-reduced tubing, then it is advantageous if the temperature at which the solution annealing is carried out is the same temperature at which the stretch-reducing (i.e. the diameter reduction due to stretching) of the initially formed tube is begun. In this case, a separate solution annealing for the stretch-reduced tubes is no longer required, owing to the fact that the cooling following the solution annealing is effected during the stretch-reducing, respectively, immediately subsequent thereto.

In some cases it may be necessary to effect a subsequent precipitation of nitrides, carbides or carbonitrides in order to obtain a further improvement in the desirable characteristics of the profile. If this is necessary, then tempering can be carried out at a temperature of 500°-600° C. This tempering may advantageously be carried out by interrupting the cooling following the solution annealing and carrying it out at reduced cooling speed in the temperature range of 500°-600° C.

The invention has a variety of advantages. One of these is that it offers an economical way of producing high-strength profiles, closed circumference tubular profiles including the requisite machine welding, without having to resort to an expensive liquid quenching and tempering. In particular, the method according to the invention and the precipitation-hardenable fine-grain steel used in conjunction with it, eliminates the lack of machine-weldability of the steels used heretofore and at the same time permits ready cold-processing of the steel during the profile manufacturing operation.

The following example will describe the invention in still greater detail for an improved understanding.

EXAMPLE

The steel having a chemical composition of

| | |
|---|---|
| 0,28% | carbon |
| 1,5% | manganese |
| 0,32% | silicone |
| 0,015% | sulfur |
| 0,025% | phosphorous |
| 0,03% | aluminum |
| 0,12% | vanadium |
| 0,015% | nitrogen |

the rest being iron and unavoidable contaminants, is hot-rolled to form a strip, particularly, a wide hot strip. Thereupon, and without any intermediate cooling, it is wound up to form a coil after the last hot-rolling operation and at a temperature of approximately 750° C. It is then subjected to cooling by overaging, i.e. it is allowed to rest in stagnant air until it reaches a temperature of 400° C.

During this cooling of the coil from the take up temperature of 750° C. at which the coil was wound up, down to the temperature of 400° C. the natural heat storage capability of the coil is used for the overaging step, during which the precipitation and coagulation of carbides, nitrides and carbonitrides (while avoiding grain refining) proceed substantially completely. The further cooling down to room temperature is effected in any desired manner. The wide hot strip, once it has been completely cooled down to room temperature respectively being subject to overaging at high temp. has a yield strength of 450 N/mm$^2$ and a tensile strength of 650 N/mm$^2$.

The strip if now slitted into small strips, if necessary trimmed and thereupon cold shaped, in this particular example being formed to an open seam tube in a continuous operation, and this tube is then converted to a closed tube having a diameter of 159 mm by welding together the longitudinally extending edges of the strip forming the open seam tube with a electric resistance welding device.

The tube thus obtained is then heated to a temperature of approximately 1030° C. and with this temperature as the starting temperature it is subjected to a stretch-reduction (i.e. diameter reduction) until it reaches the desired diameter of 60.3 mm. The finished tube is then cooled down to room temperature in stagnant air.

The coarse carbides, nitrides and carbonitrides in the steel are dissolved during the heating of the tube, respectively during the maintaining of the tube at the initial stretch-reduction temperature, and during the cooling respectively subsequent during the stretch-reduction rolling, they are precipitated in finely dispersed form at simultaneous formation of fine grain.

After this treatment the finished tube has a yield strength of 648 N/mm$^2$ and a tensile strength of 845 N/mm$^2$.

While the invention has been described herein with reference to a particular embodiment and application, it will be understood that it is not limited thereto and that various modifications may offer themselves to those skilled in the art, which modifications are intended to be encompassed within the ambit of the appended claims.

What is claimed is:

1. A method of converting pre-rolled precipitation-hardenable fine-grain medium-carbon low alloy steel plates or strips into steel profiles having a yield strength of $\geqq$500 N/mm$^2$, a tensile strength of $\geqq$600 N/mm$^2$ and high toughness, comprising the first step of cooling the rolled steel plates or strips from a final rolling temperature above the $A_1$-temperature level, down to a temperature of about 400° C. in an atmosphere which in part suppresses radiation and convection heat losses and thus reduces the cooling rate; the second step of thereafter cooling the steel plates or strips to room temperature; the third step of cold-processing the cooled steel plates or strips to form an open profile therefrom; the fourth step of subjecting the profile to annealing so as to dissolve coarse precipitants thereon; and the fifth step of cooling the profile to form finely dispersed precipitants therein; the first step of cooling comprising maintaining the steel plate in a furnace atmosphere during the cooling for overaging at high temperature; said third step comprising further the sixth step of converting the open profile into a tube by welding adjacent longitudinal edges of the profile together; said fourth step comprising further the seventh step of solution-annealing the profile above the $A_{C3}$-temperature; the eighth step of subjecting the tube to diameter reduction by longitudinal stretching at an initial stretch-pass temperature corresponding to said solution-annealing temperature; said fifth step comprising further the ninth step of cooling the profile subsequent to said annealing, and tenth step of interrupting the cooling at a temperature of 600° C. and continuing the cooling in the 500°–600° C. temperature range at reduced cooling speed to achieve a yield strength of 648 N/mm$^2$; the steel having a composition of:

| | |
|---|---|
| 0.28% | carbon |
| 1.5% | manganese |
| 0.32% | silicone |
| 0.015% | sulfur |
| 0.025% | phosphorous |
| 0.03% | aluminum |
| 0.12% | vanadium |
| 0.015% | nitrogen, |
| the balance being iron and impurities. | |

* * * * *